United States Patent [19]

Artzt et al.

[11] Patent Number: 4,679,388

[45] Date of Patent: Jul. 14, 1987

[54] PROCESS AND APPARATUS FOR FRICTION SPINNING

[75] Inventors: Peter Artzt; Hans Rottmayr; Wolfgang Bauer, all of Reutlingen, German Democratic Rep.

[73] Assignee: Schubert & Salzer, Ingolstadt, Fed. Rep. of Germany

[21] Appl. No.: 797,816

[22] Filed: Nov. 14, 1985

[30] Foreign Application Priority Data

Nov. 15, 1984 [DE] Fed. Rep. of Germany ..... 3441678

[51] Int. Cl.[4] ..... D01H 7/882; D01H 15/02

[52] U.S. Cl. ..... 57/263; 57/401

[58] Field of Search ..... 57/263, 401, 356, 417

[56] References Cited

U.S. PATENT DOCUMENTS

| | | | |
|---|---|---|---|
| 4,098,066 | 7/1978 | Stahlecker | 57/263 X |
| 4,334,400 | 6/1982 | Fehrer | 57/5 |
| 4,367,623 | 1/1983 | Parker et al. | 57/263 |
| 4,485,618 | 12/1984 | Anzinger | 57/401 X |
| 4,497,168 | 2/1985 | Kamp | 57/401 |
| 4,514,974 | 5/1985 | Stahlecker | 57/401 |
| 4,539,804 | 9/1985 | Derichs | 57/263 |
| 4,539,807 | 9/1985 | Stahlecker | 57/401 |
| 4,563,872 | 1/1986 | Stahlecker | 57/263 |

FOREIGN PATENT DOCUMENTS 3315983 11/1984 Fed. Rep. of Germany .

*Primary Examiner*—Stanley N. Gilreath
*Assistant Examiner*—Joseph J. Hail, III
*Attorney, Agent, or Firm*—Dority & Manning

[57] ABSTRACT

In a friction-spinning process, the fibers (30) are twisted together on a thread formation line (43) as a result of the rotation of two friction elements (1, 10) driven in the same direction and forming a V-shaped nip and are drawn off as a thread (4). For piecing, the thread (4) is returned into the piecing position outside this thread formation line (43) and only then is placed in the thread formation line (43). During the run-off of the thread (4) from the friction elements (10), the pressing force of the thread (4) against at least one of the friction elements (10) is increased. For this purpose, a thread guide element (5) is arranged directly after the friction elements (10) and is movable transversely relative to the thread draw-off direction (42).

15 Claims, 8 Drawing Figures

PROCESS AND APPARATUS FOR FRICTION SPINNING

The present invention relates to a process for friction spinning, in which the fibers are twisted together on a thread formation line as a result of the rotation of two friction elements driven in the same direction and forming a V-shaped nip and are drawn off as a thread, and to an apparatus for carrying out this process.

A process and an apparatus of this type are described in European Published Application No. 0,034,427. According to this specification, the fibers are fed from an opening device, via a fiber channel, into the V-shaped nip between the two friction elements designed as rollers. As a result of the rotary movement of the two rollers, the fibers are twisted together into a thread and, in an extension of the V-shaped nip, are drawn off from the V-shaped nip through a thread draw-off tube. A pair of rollers is provided as a thread draw-off device.

To achieve a good twisting take-up of the thread by the friction elements, the friction elements are arranged relative to one another in such a way that the thread is as deep as possible in the V-shaped nip. The slip between the friction elements and the thread is kept low in this way.

After a thread break, the thread end has to be introduced into the spinning apparatus again, that is to say the open end of the thread has to be introduced into the V-shaped nip again between the two friction rollers through the thread draw-off tube. It is difficult, however, to insert the thread end into the narrow V-shaped nip so that it is stretched. Expensive additional devices and air guides are necessary for this purpose.

The object of the invention is, therefore, to provide a process and an apparatus for friction spinning, which guarantee simple and reliable piecing, but in which a twist is reliably generated in the thread during the subsequent spinning process also.

According to the invention, this object is achieved because, for piecing, the thread is returned to the piecing position outside the thread formation line and only then is placed in the thread formation line, and the spinning process starts again subsequently. Since the thread end is outside the thread formation line during the return, it can be brought into the piecing position without difficulty and without being impeded by the friction elements. Only when the thread end has reached its axial position necessary for piecing is it placed in the thread formation line, so that the thread formation process can then be initiated and carried out.

Preferably, in addition, to influence the spinning conditions, not only is the thread placed in the thread formation line, but, when the thread runs off from the friction elements, its pressing force against at least one of the friction elements is increased. The generation of twist and also the appearance of the thread can be influenced as a result.

To carry out the process according to the invention, a thread guide element arranged directly after the friction elements is movable transversely relative to the thread draw-off direction, so that it can bring the thread into the position required for return, piecing and spinning. As a result of the movement of the thread guide element in the plane of the V-shaped nip, the thread is drawn into the V-shaped nip and an increased effect of the friction elements is consequently achieved. As a result of the counter-movement of the thread guide element, the thread can be returned into the piecing position unimpeded. It is advantageous if the thread guide element is movable transversely relative to the plane of the V-shaped nip, in addition to its movement along the plane of the V-shaped nip, in order preferably to bring the thread up against the friction element rotating into the V-shaped nip.

No additional thread guide element is required for this; it is expedient if the conventional thread draw-off tube is mounted so as to be appropriately movable.

In a further embodiment of the subject of the invention, so that the thread can be influenced, during the draw-off, not only by the friction elements, but also by the thread draw-off tube, advantageously the thread draw-off tube is movable axis-parallel relative to the thread formation line or alternatively is pivotable about an axis extending transversely relative to the thread draw-off direction.

Where many fiber materials are concerned, it is advantageous if the thread, when it is being drawn off from the V-shaped nip, is not deflected again from its stretched position at the mouth of the thread draw-off tube, immediately after it leaves the V-shaped nip. For this purpose, the thread draw-off tube can be movable concentrically relative to the end of the thread formation line which limits the thread formation line of the friction elements in the direction of the thread draw-off tube. This can be achieved if the thread draw-off tube is pivoted or guided in a slotted-link guide.

The effect of a change in the pressing force between the thread and the friction element can also be increased if one or both of the thread contact surfaces facing one another, of the friction elements and of the thread guide element have a surface with an increased coefficient of friction and/or a profiling. It is not necessary for this thread contact surface with the increased coefficient of friction and/or the profiling to be located constantly in the thread draw-off region. Should this be disadvantageous during the normal spinning process, it is possible, according to the invention, for this thread contact surface to be brought into the thread draw-off path only as a result of a movement of the thread guide element.

The subject of the invention has a simple design and makes it possible to influence the spinning process in its various work phases. For the return of the thread into the piecing position between the friction elements, which can be of any design, the friction between the thread and the friction elements is cancelled completely. To increase the twist in the thread during the piecing draw-off, but also to improve the twisting take-up of the thread by the friction elements, the pressing force between the thread and friction elements can be varied in steps or continuously. As a result, on the one hand piecing reliability and the strength of the thread joins are increased, and on the other hand the character of the yarn, especially the roughness of the yarn, can be varied in many ways.

Exemplary embodiments of the subject of the invention are explained below with reference to drawings. In the drawings.

Figure 1:
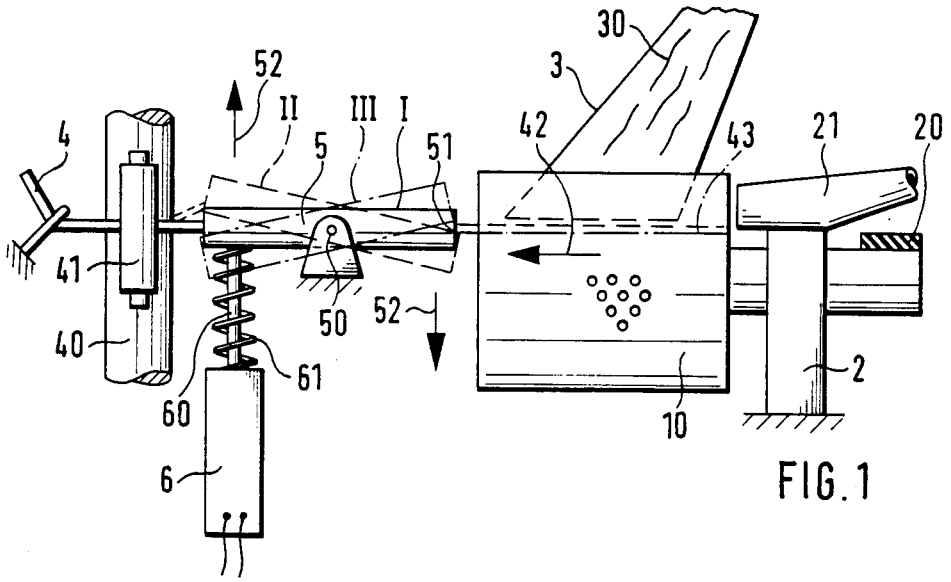
FIG. 1 shows a side view of a first exemplary embodiment of a friction-spinning apparatus designed according to the invention and having a pivotable thread draw-off tube.
Figure 7:
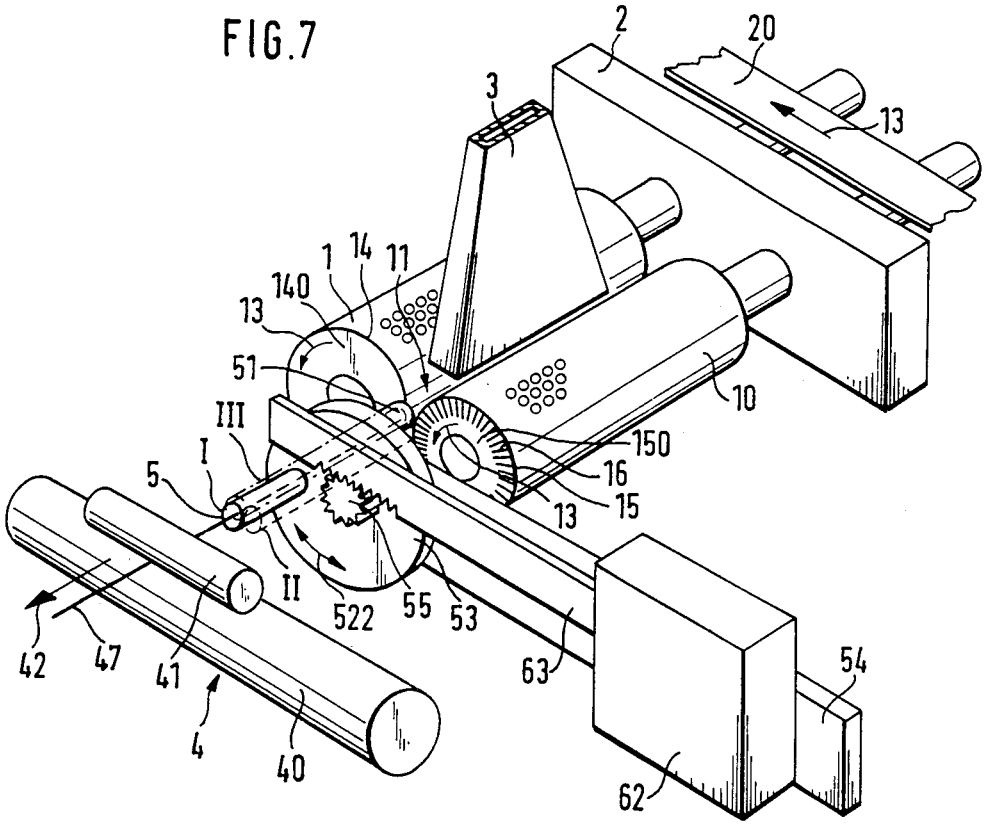
FIG. 7 shows, in a perspective representation, a friction-spinning apparatus according to the invention, with a thread draw-off tube which is adjustable axis-parallel relative to the thread formation line.

According to FIGS. 1 and 7, the friction-spinning apparatus contains two rotationally symmetrical friction elements in the form of two cylindrical friction rollers 1 and 10 forming a V-shaped nip 11 or spinning gusset. The two friction rollers 1 and 10 are perforated and during spinning are subjected to suction in the region of the V-shaped nip 11. For this purpose, they are connected to a suction device in a way not shown.

The two friction rollers 1 and 10 are mounted in a bearing 2 and are driven in the same direction (see the arrow 13) by means of a tangential belt 20.

Assigned to the friction rollers 1 and 10 is a fiber feed device (not shown), from which the fibers 30 are guided via a fiber feed channel 3 into the V-shaped nip 11 of the friction rollers 1 and 10.

The thread 47 is drawn off from the V-shaped nip 11 by means of a thread draw-off device 4 which consists of a drive roller 40 and a pressure roller 41 pressed against the drive roller 40 by a loading means. The thread 47 is wound onto a bobbin (not shown). On the side of the friction rollers 1 and 10 which faces away from the thread draw-off device 4, a suction device 21 is arranged at the height of the V-shaped nip 11.

A thread guide element designed as a thread draw-off tube 5 is located in the thread run between the friction rollers 1 and 10 and the thread draw-off device 4. The thread draw-off tube 5 is mounted so as to be pivotable about an axle 50 transversely relative to the thread draw-off direction (the arrow 42). An electromagnet 6 connected to the thread draw-off tube via a coupling member 60 serves as a drive. This coupling member 60 is surrounded by a compression spring 61 which is supported at one end on the thread draw-off tube 5 and at the other end on the housing of the electromagnet 6, so that, when the electromagnet 6 drops, the thread draw-off tube 5 is pivoted into its position II represented by dot-and-dash lines.

According to FIG. 1, the thread guide element designed as a thread draw-off tube 5 is pivoted parallel to the plane of representation in the plane 12 of the V-shaped nip (see FIG. 2), so that during this pivoting movement a thread 47 drawn off through the thread draw-off tube 5 is shifted in the plane 12 of the V-shaped nip. The plane 12 of the V-shaped nip refers here, to the plane the position of which is fixed by the common tangent of the two friction rollers 1, 10.

In the known friction-spinning process, the thread 47 is drawn off in an extension of the thread formation line 43, so that the thread 47 assumes a stretched state from this thread formation line 43 between the two friction rollers 1 and 10 upto the thread draw-off device 4. The corresponding pivoting position of the thread draw-off tube 5 is represented by unbroken lines in FIG. 1 (position I).

To ensure, for piecing, that the thread end can be brought, unimpeded by the rotating friction elements 1 and 10, into the piecing position in which this thread end extends over the entire length of the thread formation line 43, the thread draw-off tube 5 is pivoted into the position designated by III in FIG. 1. The thread draw-off device 4 is driven in the opposite direction to the normal thread draw-off direction, so that the thread 47 is returned to the friction elements 1 and 10 in the opposite direction to the arrow 42. The thread end leaving the thread draw-off tube 5 in the direction of the friction elements 1 and 10 is now located outside the thread formation line 43 and is brought into the piecing position by means of a suction-air stream flowing into the suction device 21. When the supply of current to the electromagnet 6 is cut off, the thread draw-off tube 5 is consequently brought into the position I again by means of the relaxing compression spring 61. As a result, the thread 47 is placed in the thread formation line 43 for tying in the fibers.

The fiber feed into the V-shaped nip 11 is switched on again and the direction of rotation of the thread draw-off device 4 is reversed. The thread 47 is then drawn off from the V-shaped nip 11, with the fibers 30 supplied continuously to the V-shaped nip 11 being tied in continuously.

Where many fiber materials are concerned, the tying-in of the fibers is unsatisfactory here. Even a change in the rotational speed of the friction rollers 1, 10 can only improve the twisting take-up of the thread 47 to a limited extent, since this take-up depends less on the rotational speed of the friction rollers 1, 10 than on the friction between the friction rollers 1, 10 and the thread 47. This means that, whenever the material is changed, friction rollers 1, 10 with different friction properties in relation to the fiber material would have to be used if a uniform twisting take-up were always to be guaranteed. In the apparatus illustrated in FIG. 1, this is avoided because the thread draw-off tube 5 is pivoted in the direction of the arrow 52. For this purpose and to make it possible for the thread draw-off tube 5 to assume intermediate positions, in a modification of the apparatus described there is, instead of the electromagnet 6 (FIG. 1), a stepping drive 62 (see, for example, FIG. 7), by means of which the thread draw-off tube 5, via the coupling member 60, can be pivoted selectively in one direction or the other over the desired distance. In this way, the twisting take-up of the thread 47 can be varied practically continuously as a result of a variation in the pressing force of the thread 47 on the friction rollers 1, 10. As shown in FIG. 1, when the thread draw-off tube 5 is pivoted in the direction of the arrow 52, the thread 47 is consequently pressed against the friction elements 1 and 10 on the end of the latter facing the thread draw-off device 4, so that the thread pressing force is increased in this end region in comparison with the remaining region of the thread formation line 43.

When the thread 47 is drawn off from the thread formation line 43, with the mouth 51 of the thread draw-off tube 5 being in position III, the thread formation line 43 is shortened, thus also reducing the twisting take-up. This can be advantageous in many cases.

The amount of pressing force producing the best possible results during piecing or during spinning itself depends on various factors, such as the surface and rotational speed of the friction rollers 1 and 10, the fiber material to be spun, the yarn count, etc.

Figure 8:
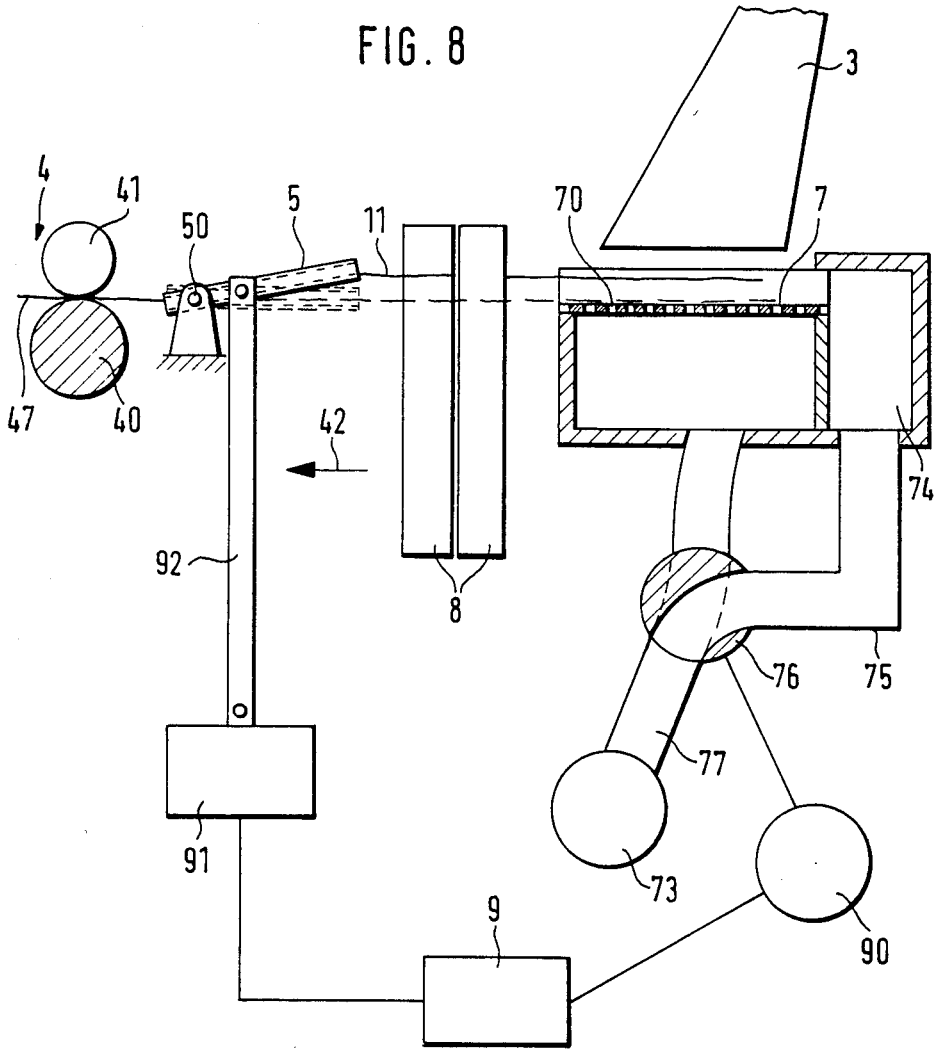
FIG. 8 shows a side view of a friction-spinning apparatus, in which the thread formation line extends from the V-shaped nip between the friction elements upto a fiber-collecting surface.

To prevent additional deflection of the thread 47 between the thread draw-off device 4 and the thread draw-off tube 5, a guide 45 (FIG. 5) can be connected to the thread draw-off tube 5 and carries the thread 47 along, at least at the outlet of this thread draw-off device 4, axially relative to the nip between the drive roller 40 and the pressure roller 41. Alternatively, the thread draw-off device 4 or an auxiliary draw-off device (not shown) can also be mounted together with the thread draw-off tube 5 so as to be pivotable. It is also possible, however, to locate the axle 50, about which the thread draw-off tube 5 is pivoted, at the end of the thread draw-off tube 5 facing the thread draw-off device 4, so that this end changes its angle, but does not change its position relative to the thread draw-off device 4 (FIG. 8).

Figure 2:
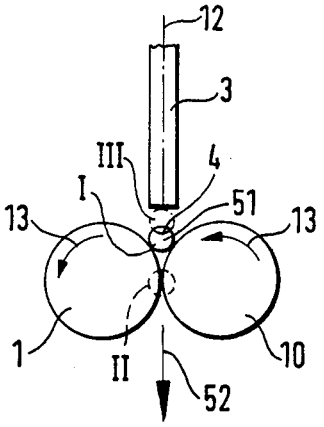
FIG. 2 shows a front view, seen from the thread draw-off side, of a friction-spinning apparatus with a thread draw-off tube movable in the plane of the V-shaped nip.
Figure 3:
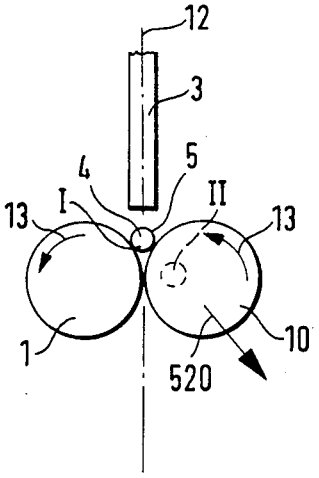
FIGS. 3 and 4 show the apparatus illustrated in FIG. 2, with a thread draw-off tube movable at an angle to the plane of the V-shaped nip.

As shown in FIG. 2, during these pivoting movements the thread draw-off tube 5 is moved along the plane 12 of the V-shaped nip, but other directions of movement can also be determined for the thread draw-off tube 5. FIG. 3 shows a friction-spinning apparatus in which the thread draw-off tube 5 executes, in addition to this movement along the plane 12 of the V-shaped nip, a movement component (arrow 520) towards the friction roller 10 rotating into the V-shaped nip 11 (see arrow 13). This is advantageous particularly when, in contrast to FIG. 1, only the friction roller 1 is subjected to suction, whilst the friction roller 10 is designed as a frictional-contact roller. This friction roller 10, when it rotates in the direction of the arrow 13, presses the thread 47, resting against it with an increased pressing force, into the V-shaped nip 11. For this purpose, the axle 50 shown in FIG. 1 for the thread draw-off tube 5 can be mounted an appropriate distance away from the perpendicular to the plane 12 of the V-shaped nip.

FIG. 7 shows another exemplary embodiment, in which the thread draw-off tube 5 is mounted in a cam disk 53 supported rotatably by a bearing 54. Part of the axle of the cam disk 53 is designed as a pinion 55, with which a rack 63 is engaged. This rack 63 is driven selectively in one direction or the other by means of a stepping drive 62.

When the cam disk 53 is adjusted along the double arrow 522, the thread draw-off tube 5 always maintains its axis-parallel position relative to the thread formation line 43. As shown in FIG. 7, the axle of the cam disk 53 is arranged so that, when the thread draw-off tube 5 moves out of the position I represented by an unbroken line into the position III, for example for piecing, the thread draw-off tube 5 virtually moves along the plane 12 of the V-shaped nip (FIG. 2), whereas the thread draw-off tube 5, when it moves out of its position I in an extension of the thread formation line 43 (FIG. 1) into the position II, acquires a movement component towards the friction roller 10 rotating into the V-shaped nip 11 (see arrow 13).

As a result of the shift of the thread draw-off tube 5 into the position II, the thread 47 is pressed against the peripheral edges 14 and 15, facing the thread draw-off tube 5, of the friction rollers 1 and 10. The twisting take-up of the thread 47 by the friction rollers 1 and 10 can thus be influenced substantially by these peripheral edges 14 and 15. To improve the twisting take-up even further, according to FIG. 7 the thread contact surfaces 140 and 150 facing the thread draw-off tube 5 are provided, in the region of these peripheral edges 14 and 15, with a profiling 16 in the form of notches. Webs, graining, etc. can also be provided instead of notches. It is even possible, in addition to or instead of a profiling 16, for the thread contact surfaces 140 and 150 to have a surface with an increased coefficient of friction in the region of the peripheral edges 14 and 15. For this purpose, this region can, for example, be provided with a covering made of rubber, etc.

Figure 4:
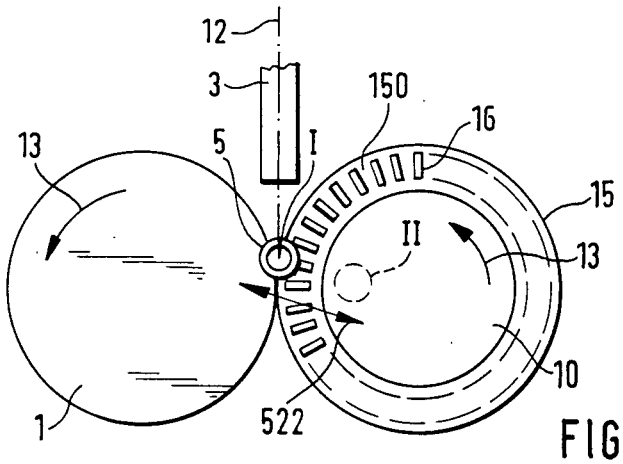

To ensure that, when the thread draw-off tube 5 moves transversely relative to the plane 12 of the V-shaped nip, the thread 47 being formed is not lifted out of the V-shaped nip 11, the mouth 51 (FIG. 5) of the thread draw-off tube 5, during its movement out of the extended thread formation line 43, is shifted towards the friction roller 10 rotating in the direction (arrow 13) of the V-shaped nip 11 (FIG. 4: arrow 522). The friction roller 10 thus picks up the thread 47 and takes it to the Vshaped nip 11.

Figure 5:
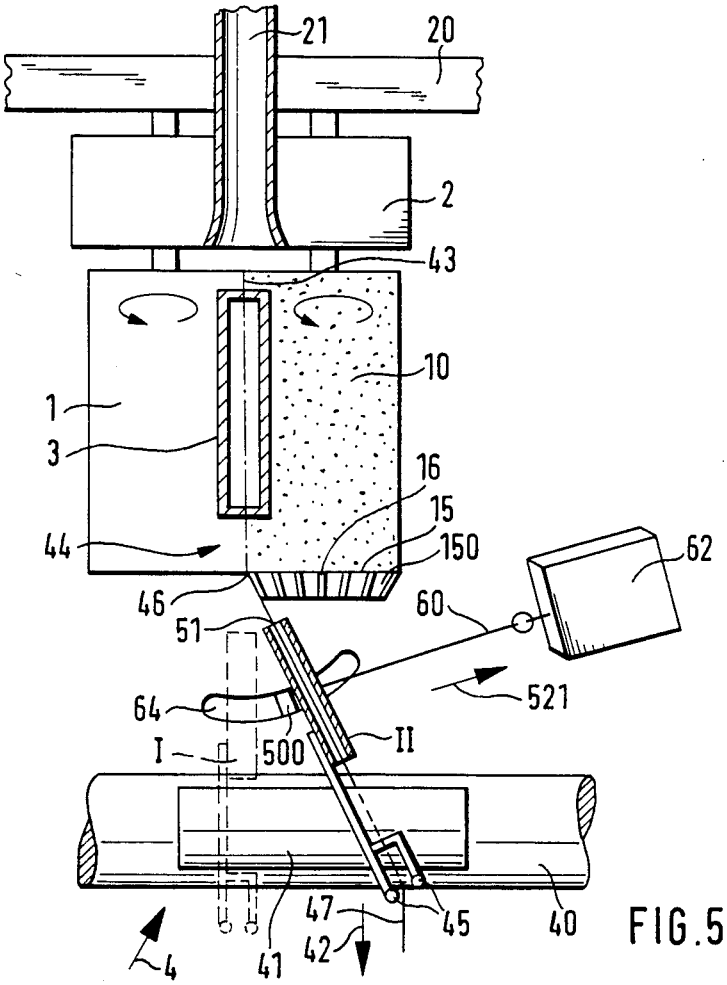
FIG. 5 shows a plan view of a friction-spinning apparatus with a thread draw-off tube which is movable concentrically relative to the end of the thread formation line limiting the thread formation line of the friction elements in the direction of the thread draw-off tube.

A further example of such a design is shown in FIG. 5. To prevent the drawn-off yarn 47 from being deflected at the mouth 51, facing the friction rollers 1 and 10, of the thread draw-off tube 5, according to this design the thread draw-off tube 5 is pivotable concentrically relative to the end 46 of the thread formation line 43 facing the thread draw-off tube 5. For this purpose, the thread draw-off tube 5 is guided in a slotted-link guide 64 by means of a sliding block 500. The thread draw-off tube 5 is connected via a coupling member 60 to a stepping drive 62, by means of which it can be adjusted along the slotted-link guide 64. For piecing, the thread draw-off tube 5 is in the position I represented by a broken (sic) line, in which the returned thread 47 assumes a stretched state from the draw-off device 4 into the thread formation line 43. To improve the twisting take-up after piecing has been carried out, the thread guide tube 5 is brought into the position II by means of the stepping drive 62. Because the thread 47 being drawn off is deflected as a result, it comes up against the thread contact surface 150, thereby brought into the thread draw-off path, of the friction roller 10, so that the twisting take-up is improved not only as a result of a variation in the pressing force of the thread 47 on the peripheral edge 15 of the friction roller 10, but also because of this thread contact surface 150 additionally acting on the thread 47.

Instead of the slotted-link guide 64 shown in FIG. 5, there can also be a pivot axle (not shown) for the thread draw-off tube 5, this pivot axle extending through the end of the thread formation line 43 facing the thread draw-off device 4.

In the exemplary embodiments discussed above, a thread contact surface 140 or 150 with an increased coefficient of friction or with a profiling 16 was described only in conjunction with the friction rollers 1 and 10. If desired, however, instead of or in addition to one or more such thread contact surfaces 150 on the friction rollers 1 and 10, the mouth 51, facing the friction rollers 1, 10, of the thread draw-off tube 5 can also have a thread contact surface (not shown) formed in this way. It is also possible at the same time to give this thread contact surface a conically widening form, so that this thread contact surface can be brought into the thread draw-off path simply by shifting the thread draw-off tube 5.

In the exemplary embodiments illustrated in FIGS. 1 to 5 and 7, a thread draw-off tube 5 movable transversely relative to the thread draw-off path is always shown as a thread guide element. However, such a thread draw-off tube 5 is not a precondition for achieving the sought-after objects and can be replaced by other thread guide elements. Thus, for example, the thread guide element can be used as a thread guide lug (not shown) displaceable transversely relative to the thread draw-off path.

Figure 6:
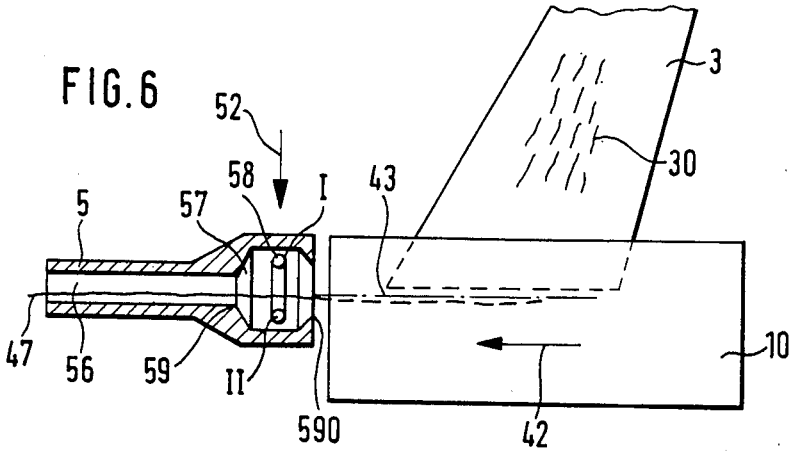
FIG. 6 shows a side view of a friction-spinning apparatus designed according to the invention, with a guide element movable independently of a thread draw-off tube.

FIG. 6 shows a modified friction-spinning apparatus with a stationary thread draw-off tube 5, in the mouth 51 of which there is a biconical chamber 57 larger than the remaining inside diameter of the thread draw-off tube 5. This chamber 57 contains a thread guide element designed as a stirrup 58. In the position I shown, this stirrup 58 is in such a position relative to the thread 47 that the latter assumes a stretched state between the thread formation line 43 and the thread draw-off tube 5. To press the thread 47 being drawn off against the friction rollers 1 and 10 with greater force, the stirrup 58 is brought into the position II in the direction of the arrow 52. The stirrup 58 thus shifts the thread 47, so that the latter is pressed against the peripheral edges 14 and 15 (FIG. 7) of the friction rollers 1 and 10 on one side and against the edge 59 between the chamber 57 and the bore 56 of the thread draw-off tube 5 on the other side.

The thread guide element can also take another form instead of that of the stirrup 58, for example the form of a fork, etc.

Even in the design illustrated in FIG. 6, the thread guide element (for example, a stirrup 58), the edge 59 of the chamber 57 or the edge 590 limiting the chamber 57 in the direction of the friction rollers 1 and 10 can be designed as a thread contact surface with an increased coefficient of friction or as a profiling 16 (see FIG. 7). If several thread contact surfaces 590, 58 and 59 of this type are provided, they can also be formed differently to influence the roughness or smoothness of the thread 47. Thus, for example, the thread 47 can undergo a kind of secondary polishing or smoothing by means of smooth edges.

The design of the thread contact surface, irrespective of its arrangement on one or both of the friction rollers 1 and 10, on the thread draw-off tube 5 or on the stirrup 58 or even on several elements at the same time, depends on the desired twisting take-up and/or on the desired appearance of the yarn.

In the exemplary embodiments described above, the thread formation line 43 is formed solely by the friction elements designed as friction rollers 1 and 10. As shown in FIG. 8, however, it is also possible, in a modification of this, to provide a stationary fiber-collecting surface 7 which is followed in the thread draw-off direction (the arrow 42) by the two friction elements 8 driven in the same direction, so that the thread formation line 43 includes the V-shaped nip 11 between the friction elements 8 and the fiber-collecting surface 7. This fiber-collecting surface 7 is subjected to suction. For this purpose, it is connected via a plurality of bores 70 to a suction chamber 71 connected to a line 72. On the side of the fiber-collecting surface 7 facing away from the friction elements 8, there is a further suction chamber 74 connected to a line 75. The two lines 72 and 75 can be connected alternately via a reversing valve 76 to a suction line 77 itself connected to a suction source 73. For this purpose, a drive 90 is assigned to the reversing valve 76.

In the exemplary embodiment illustrated, the friction elements 8 are designed as a pair of friction disks which are driven in the same direction in a way not shown.

A thread guide element designed as a thread draw-off tube 5 is arranged between the friction elements 8 and the thread draw-off device 4 designed as a pair of rollers and is mounted pivotably about an axle 50 at its end facing the thread draw-off device 4. This thread draw-off tube 5 is connected to a drive 91 via a drive rod 92.

The drives 90 and 91 are connected for control purposes to a control device 9 which makes the desired adjustments of the reversing valve 76 and thread draw-off tube 5 respectively as a function of a manual control or a preset program.

To return the thread 47 to the fiber-collecting surface 7 for piecing purposes, the control device 9 actuates the drive 91 which pivots the thread draw-off tube 5 out of the position represented by broken lines into the position represented by unbroken lines. Moreover, the control device 9 causes the reversing valve 76 to be switched from the position indicated by broken lines into the position illustrated, in which the suction source 73 is connected to the suction chamber 74.

As a result of the adjustment of the thread draw-off tube 5, when the pair of rollers forming the thread draw-off device 4 are rotated in reverse the thread 47 is guided back outside the V-shaped nip 11 between the friction elements 8. It can thus follow unimpeded the air stream flowing into the suction chamber 74. When the thread 47 has reached its piecing position, which can be determined by a thread monitor or, where thread ends brought to a specific piecing length are concerned, by counting the rotations of the drive roller 40, the piecing operation is initiated by the control device 9. For this purpose, the thread draw-off tube 5 and the reversing valve 76 are brought to their spinning position (represented by broken lines) again. The end of the thread 47 is drawn towards the fiber-collecting surface 7 by the suction-air stream now taking effect again in the suction chamber 71. Furthermore, the thread 47 now reenters the V-shaped nip 11 formed by the friction elements 8 and thus comes in contact with these friction elements 8. The fiber feed and the start of the thread draw-off are now controlled in the usual way which is therefore not described in any more detail.

It is also possible for the drive 91 to press the thread 47 into the V-shaped nip 11 with greater force with the aid of the thread draw-off tube 5, irrespective of the piecing program. The generation of twist and the appearance of the thread 47 (roughness or smoothness) can be influenced as a result of an appropriate shaping or surface design of the friction elements 8 and/or of the thread draw-off tube or as a result of a combination of these.

In contrast to the design illustrated in FIG. 8, the friction elements 8 can also be designed as relatively long rollers, etc. It is also possible to provide more than merely two friction elements 8, and in relation to the thread draw-off direction these can be arranged either in the same planes or in planes offset relative to one another (see FIG. 8).

We claim:

1. A process for friction spinning, in which fibers are twisted together to form a thread in a V-shaped nip formed by rotation of two frictional elements driven in the same direction, comprising:

piecing such thread by returning formed thread to the vicinity of the rotating frictional elements, but deflected from a straight thread formation line parallel with the V-shaped nip; and then placing said thread into said thread formation line; and commencing spinning thread from fibers by feeding such fibers to the rotational frictional elements and drawing off said thread along said thread formation line, thereby deflecting said thread from a plane defined through such thread formation line and perpendicular to the plane of the rotation axes of the frictional elements, wherein such deflection includes directing the thread with controllable force into at least one peripheral edge of the frictional elements having enhanced frictional engagement characteristics, whereby improved twisting take-up results.

2. A process as in claim 1, wherein controlling said force includes selectively establishing the angle of said deflection.

3. A process as in claim 2, further including providing a controllably movable thread guide element for selectively deflecting and directing said thread.

4. A process as in claim 3, wherein said thread guide element is movable axis-parallel relative said thread formation line.

5. A process as in claim 3, wherein said thread guide element is pivotable about an axis extending transversely relative said thread formation line.

6. A process as in claim 5, wherein an end of said thread guide element is concentrically pivotable relative an end of said thread formation line, whereby said angle of deflection is selectively established.

7. An apparatus for performing friction spinning, comprising:

a pair of rotatable friction elements for defining a thread formation line therealong in a V-shaped nip formed therebetween, at least one of said rotatable elements having a peripheral edge with enhanced frictional engagement characteristics;

fiber feed means for feeding fiber material to said V-shaped nip;

thread draw-off means for selectively drawing formed thread away from said rotatable elements during spinning operation; means for directing earlier drawn-off thread towards said rotatable elements during piecing operation;

controllable thread guide means, situated between said rotatable elements and said thread draw-off means for guiding thread generally therebetween in at least two selectable positions thereof, including one position in which thread is guided directly along said thread formation line for stretching thereof, and a position in which thread is guided towards said peripheral edge for enhanced twisting thereof; and actuation means for controllably moving said controllable thread guide means between said at least two positions thereof, whereby the frictional engagement between said rotatable elements and the thread may be controllably and selectively enhanced.

8. An apparatus as in claim 7, wherein said thread guide means includes additional positions thereof, with each additional position directing thread towards said peripheral edge with respective controlled force; and said actuation means further controls movement of said controllable thread guide means among all positions thereof so as to more precisely control the frictional engagement of the rotatable elements and the thread; and wherein several of said positions of said thread guide means other than said one position thereof directs thread towards said peripheral edge along a line transverse to a plane intersecting said V-shaped nip and perpendicular to the plane of the rotatable elements axes of rotation.

9. An apparatus as in claim 8, wherein said controllable thresd guide means include a thread draw-off tube, the position of which may be controlled by said actuation means, said tube having one mouth adjacent said rotatable elements and another mouth adjacent said thread draw-off means.

10. An apparatus as in claim 9, wherein said actuation means includes means for controllably directing said one tube mouth adjacent said rotatable elements at selected positions between one position thereof along said thread formation line and respective positions directed at varying degrees axially inward towards the center of said at least one rotatable element having said peripheral edge.

11. An apparatus as in claim 9, wherein said actuation means includes means for moving said tube and said mouth thereof adjacent said rotatable elements concentrically relative such elements, whereby the force with which the thread is directed against said peripheral edge is variably controlled.

12. An apparatus as in claim 9, wherein said actuation means includes means for adjusting the position of said tube so that the axis thereof moves parallel to said thread formation line so as to vary the force with which the thread is directed against said peripheral edge of said at least one rotatable element.

13. An apparatus as in claim 7, wherein said peripheral edge includes a conic section formed at an end of said at least one rotatable element nearer said thread draw-off means.

14. An apparatus as in claim 7, wherein said peripheral edge includes raised profiling thereon for providing said enhanced frictional engagement characteristics thereof.

15. An apparatus as in claim 7, wherein said peripheral edge includes a surface defined by a predetermined material such as rubber for providing said enhanced frictional engagement characteristics thereof.

* * * * *